US011352155B2

(12) United States Patent
Chtourou et al.

(10) Patent No.: US 11,352,155 B2
(45) Date of Patent: Jun. 7, 2022

(54) REPULPABLE PAPER STRAP WITH ENHANCED MOISTURE RESISTANCE AND METHODS TO MAKE THE SAME

(71) Applicant: Enterprises International, Inc., Hoquiam, WA (US)

(72) Inventors: Halim Chtourou, Kirkland (CA); Michael Lee Reynolds, Hoquiam, WA (US)

(73) Assignee: ENTERPRISES INTERNATIONAL, INC., Hoquiam, WA (US)

( * ) Notice: Subject to any disclaimer, the term of this patent is extended or adjusted under 35 U.S.C. 154(b) by 0 days.

(21) Appl. No.: 16/551,212

(22) Filed: Aug. 26, 2019

(65) Prior Publication Data

US 2020/0071009 A1 Mar. 5, 2020

Related U.S. Application Data

(60) Provisional application No. 62/723,926, filed on Aug. 28, 2018.

(51) Int. Cl.

| | |
|---|---|
| ***B65B 27/12*** | (2006.01) |
| ***B65B 13/02*** | (2006.01) |
| ***B31C 99/00*** | (2009.01) |

(52) U.S. Cl.

CPC ..... *B65B 27/12* (2013.01); *B31C 13/00* (2013.01); *B65B 13/02* (2013.01)

(58) Field of Classification Search

CPC ..... B65B 27/12; B65B 13/02; B31C 13/00; B31D 5/0091; B31D 1/0056; D21H 19/20; D21H 19/82; D21H 19/824; D21H 27/00

See application file for complete search history.

(56) References Cited

U.S. PATENT DOCUMENTS

| | | | | |
|---|---|---|---|---|
| 5,066,363 | A | 11/1991 | Lee et al. | |
| 6,190,502 | B1 | 2/2001 | Takeuchi et al. | |
| 7,842,362 | B2 | 11/2010 | Kim et al. | |
| 10,309,061 | B2 * | 6/2019 | Chtourou | B29C 70/521 |
| 2007/0068641 | A1 * | 3/2007 | Dever | B32B 3/30 162/124 |
| 2013/0202870 | A1 * | 8/2013 | Malmborg | C08K 7/02 428/220 |
| 2017/0350070 | A1 * | 12/2017 | Matsumoto | D21H 21/14 |
| 2018/0162004 | A1 * | 6/2018 | Kettula | B26D 7/04 |
| 2019/0075842 | A1 * | 3/2019 | Caenen | B65B 27/12 |
| 2020/0063368 | A1 * | 2/2020 | Parker | D21H 11/14 |
| 2020/0362078 | A1 * | 11/2020 | Amano | C09D 129/04 |

FOREIGN PATENT DOCUMENTS

| | | | |
|---|---|---|---|
| CN | 1207431 | A | 2/1999 |
| CN | 101415883 | A | 4/2009 |
| GB | 915987 | A | 1/1963 |
| WO | 2016/196745 | A1 | 12/2016 |

OTHER PUBLICATIONS

International Search Report and Written Opinion for PCT/US2019/048176 , dated Nov. 27, 2019, 13 pages.

* cited by examiner

*Primary Examiner* — Robert Sandy
*Assistant Examiner* — Louis A Mercado
(74) *Attorney, Agent, or Firm* — Seed Intellectual Property Law Group LLP

(57) ABSTRACT

A repulpable paper strap includes a plurality of paper strings, and a binder that binds the paper strings together, the binder including a partially hydrolyzed polyvinyl alcohol and a fully hydrolyzed polyvinyl alcohol. Related methods of forming the repulpable paper strap is also provided.

20 Claims, 8 Drawing Sheets

REPULPABLE PAPER STRAP WITH ENHANCED MOISTURE RESISTANCE AND METHODS TO MAKE THE SAME

BACKGROUND

Technical Field

The present disclosure is related to repulpable paper straps and, more particularly, to methods for forming repulpable paper straps with enhanced moisture resistance.

Description of the Related Art

Bale strapping generally involves securing bundles of various objects, such as paper, with, for example, steel or plastic wires. Such conventional bale strapping has several drawbacks, including hindrance in repulping or making pulp from recovered paper. In particular, the repulping process generally involves separating cellulose fibers of the sheets of paper, followed by cleaning, treating, etc., and preparing the fibers into a pulp slurry and forming paper sheets from such recycling of paper. The steel or plastic wires present an impediment to the repulping process, requiring removal of the steel or plastic wires before repulping.

Conventional solutions to address the impediment to repulping have included paper straps formed with twisted paper strings made from repulpable base paper sheet that are bonded together with a partially hydrolyzed polyvinyl alcohol (PVOH). Such conventional paper straps, however, suffer from high costs and lower strength, especially when exposed to, and saturated at, high humidity environments. By way of example, in some instances, at certain storing and/or shipping conditions, such as at high relative humidity conditions and/or at long durations, a conventional paper strap may undesirably lose its repulpability and strength characteristics.

It is, therefore, desirable to have paper straps that have enhanced moisture resistance and strength.

BRIEF SUMMARY

Embodiments described herein provide paper straps and methods that are repulpable and have enhanced moisture resistance, improved strength properties, and are capable of being repulpable at a wide variety of conditions and environments. For example, according to one embodiment, a repulpable paper strap includes a plurality of paper strings, and a binder that binds the paper strings together, the binder including a partially hydrolyzed polyvinyl alcohol and a fully hydrolyzed polyvinyl alcohol.

For example, according to one embodiment, a method of forming a repulpable paper strap includes providing a plurality of paper strings, directing the paper strings through one or more pultrusion dies, and injecting a binder to bond the paper strings, the binder including a partially hydrolyzed polyvinyl alcohol and a fully hydrolyzed polyvinyl alcohol.

DETAILED DESCRIPTION

Figure 1:
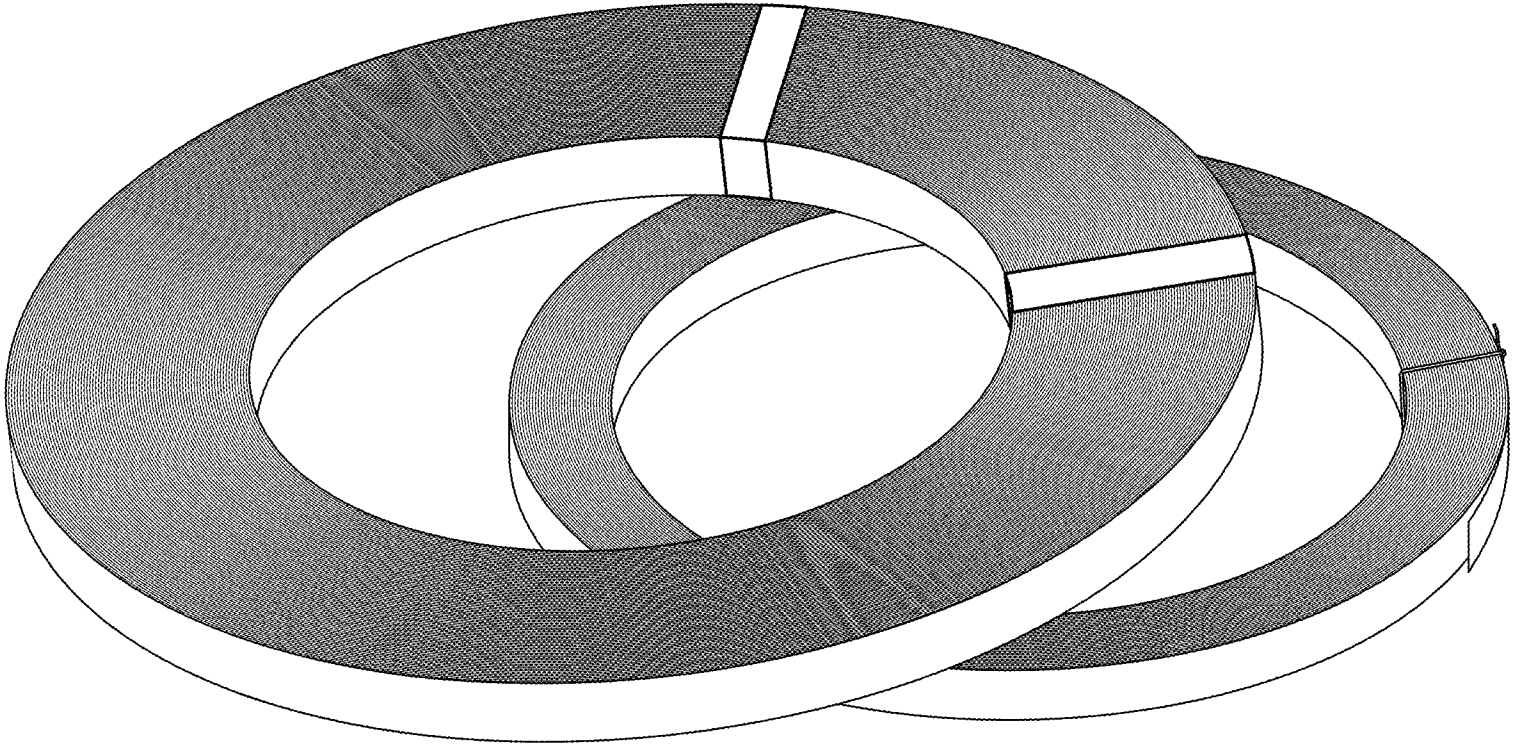
FIG. 1 is a perspective view of a paper strap according to one example, non-limiting embodiment.

In the following description, certain specific details are set forth in order to provide a thorough understanding of various embodiments. However, one skilled in the art will understand that the invention may be practiced without these details. In other instances, well-known structures have not been shown or described in detail to avoid unnecessarily obscuring descriptions of the embodiments. Unless the context requires otherwise, throughout the specification and claims which follow, the word "comprise" and variations thereof, such as "comprises" and "comprising," are to be construed in an open, inclusive sense, that is, as "including, but not limited to." Further, headings provided herein are for convenience only and do not interpret the scope or meaning of the claimed invention.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Also, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

As described above, the present disclosure is generally directed to paper straps that are repulpable. The various embodiments of the repulpable paper straps described herein can be used to secure to paper or paperboard bundles, such as Kraft paper bales, which can be repulped using conventional repulping methods known in the art. For example, the various embodiments of the paper straps described herein can secure bales which can be repulped using conventional repulping methods and processes in a hydropulper, for example.

Conventional repulping methods typically operate where water used for repulping is at a temperature of between 45 to 50 degrees Celsius. The various embodiments of the paper straps described herein not only have improved strength properties but also can be repulpable at non-conventional water temperatures of less than 45 to 50 degrees Celsius. In particular, the paper straps according to various embodiments include a plurality of paper strings that are bonded together with a hybrid binder and/or a composite binder that can improve strength properties of the paper straps, enhance moisture resistance, and allow repulpability at lower temperatures.

An embodiment of a hybrid binder described herein should be understood as a binder that comprises a partially hydrolyzed PVOH and a fully hydrolyzed PVOH at various weight percentages.

An embodiment of a composite binder described herein should be understood as a binder that comprises a partially hydrolyzed PVOH, a fully hydrolyzed PVOH, and a dicarboxylic acid at various weight percentages.

The various embodiments of the paper straps described herein can be formed by the various methods and processes, and in one or more pultrusion machines/apparatuses, described in Applicant's pending U.S. patent application Ser. No. 15/172,012 ("the '012 Application"), which is incorporated by reference in its entirety herein. For example, FIG. 1 illustrates example embodiments of a pair of rolls of paper straps. The paper straps were formed in a strap pultrusion machine and according to the methods described in the '012 Application. The paper straps include a plurality of twisted paper strings that are guided and pulled through a pultrusion die having a tapered section, followed by pulling through a straight section. A composite binder according to one or more embodiments described herein was injected to the paper strings via an impregnation system, such as a conduit, coupled to the pultrusion die. In this example embodiment, the conduit was coupled to the tapered section of the pultrusion die. Thus, the twisted paper strings are wetted and coated with the composite binder in the tapered section, and subsequently are compacted when passing through the straight section. In addition, in this example embodiment, the pultrusion die is heated at around 90 degrees Celsius via an electric heating system, which heats the composite binder. Thereafter, the twisted paper strings being formed into the paper straps are dried via a strap dryer apparatus including infrared lamps and heat guns.

In one embodiment, a hybrid binder that can bond paper strings together to form a paper strap includes a partially hydrolyzed PVOH that is water soluble and a fully hydrolyzed PVOH that is water insoluble. In one embodiment, by dry weight, the hybrid binder includes approximately 30 to 70 percent of the partially hydrolyzed PVOH and approximately 20 to 50 percent of the fully hydrolyzed PVOH. In another embodiment, by dry weight, the hybrid binder includes approximately 65 percent of the partially hydrolyzed PVOH and approximately 35 percent of the fully hydrolyzed PVOH.

In another embodiment, the hybrid binder may be "reinforced" into a composite binder by including a dicarboxylic acid. The dicarboxylic acid is selected to have restricted solubility in ambient to slightly warm water. For example, the dicarboxylic acid can be selected to exhibit solubility of approximately 2-6 grams per 100 ml in water at ambient temperature (e.g., 20-25 degrees Celsius) to slightly warm temperatures (e.g., 35-40 degrees Celsius). For example, in some embodiments, the dicarboxylic acid can comprise an adipic acid or a succinic acid. In some embodiments, the composite binder can include by dry weight approximately 35-40 percent of the dicarboxylic acid. For example, in some embodiments, the composite binder can include, by dry weight, approximately 38-40 percent of a partially hydrolyzed PVOH, approximately 20-22 percent of a fully hydrolyzed PVOH, and approximately 37-39 percent of an adipic acid.

In some embodiments, a paper strap having paper strings bonded with an aqueous composite binder according to one or more embodiments described herein provides enhanced moisture resistance, in that, the paper strap retains at least 85 to 98 percent of its tensile strength when saturated, e.g., maximum moisture absorption at certain relative humidity and temperature, at ambient storing and/or shipping conditions. As discussed above, conventional paper straps tend to lose their tensile strengths when exposed to high moisture saturation, for example, when paper straps are exposed to tough humidity (e.g., 85-90% RH) and high temperature (e.g., 35-40° C.). Table 1 demonstrates the reduction in strength loss exhibited by paper straps bonded with aqueous composite binders according to various embodiments described herein in comparison to a conventional paper strap bonded with a partially hydrolyzed PVOH.

In particular, a paper strap having thirteen strings bonded with a partially hydrolyzed PVOH sold under the tradename Poval™ 22-88 was freely conditioned, e.g., exposing both sides of the paper strap to a conditioning environment, at 23 degrees Celsius at 50 percent relative humidity, and was tested for tensile strength. To compare this paper strap, a paper strap was freely conditioned at 23 degrees Celsius at 85 percent relative humidity and tensile strength tested. The conventional paper strap exhibited a 5 percent loss in tensile strength upon saturation.

As shown in Table 1, under similar conditions, various examples of paper straps having paper strings bonded with hybrid and/or composite binders according to various embodiments described herein were also freely conditioned and tested for tensile strength. As demonstrated in Table 1, in an embodiment of a paper strap having strings bonded with a composite binder comprising a partially hydrolyzed PVOH sold under the tradename Poval™ 22-88 and an adipic acid at approximately 61 percent and 38 percent, respectively, the paper strap exhibited a tensile strength loss of approximately 3 percent upon moisture saturation. In another embodiment, a paper strap having strings bonded with a hybrid binder comprising a partially hydrolyzed PVOH sold under the tradename Poval™ 22-88 and a fully hydrolyzed PVOH sold under the tradename Poval™ 28-99 at approximately 65 percent and 35 percent, respectively, exhibited a tensile loss of approximately 2.6 percent upon saturation. In another embodiment, a paper strap having strings bonded with a composite binder comprising a partially hydrolyzed PVOH sold under the tradename Poval™ 22-88 at approximately 40 percent, a fully hydrolyzed PVOH sold under the tradename Poval™ 28-99 at approximately 21 percent, and adipic acid at approximately 39 percent exhibited tensile strength loss of approximately 2.4 percent upon saturation. Thus, as demonstrated in Table 1, the inventors have surprisingly and unexpectedly discovered that hybrid binders and/or composite binders having a partially hydrolyzed PVOH and at least one or more of a fully hydrolyzed PVOH and a dicarboxylic acid can enhance moisture resistance of repulpable paper straps.

TABLE 1

| Repulpable Embodiments | Binder Content (%) | Net Binder Content (%) | Strap Breaking Load (LBF) 48 hrs @23° C./ 50% RH | Saturation - 48 hrs @23° C./ 85% RH | Strength Loss (%) |
|---|---|---|---|---|---|
| Poval 22-88 (100%) * | 8.36 | 8.36 | 294 | 279 | 5.0 |
| Poval 22-88 + Adipic Acid (AA) (61.3%/38.7%) * | 8.77 | 5.38 | 283 | 274 | 3.3 |
| Poval 22-88 + Poval 28-99 (65%/35%) * | 8.35 | 8.35 | 286 | 279 | 2.6 |
| Poval 22-88 + Poval 28-99 + AA (39.8%/21.5%/ 38.7) ** | 7.71 | 4.73 | 206 | 201 | 2.4 |

* 13 strings;
** 10 strings

In some embodiments, a paper strap having a plurality of strings bonded with a composite binder according to the various embodiments described herein includes a single coat or a double coat of the composite binder, but not more than the double coat of the composite binder. In particular, paper strap formation may include passing a plurality of paper strings through a pultrusion die, according to the various methods and apparatuses described in the '012 Application. As described above, the paper strings are injected with a first coat of the composite binder. The first coat of the composite binder serves as the primary binder of the paper strings. The pultrusion die is heated to simultaneously initiate the drying of the paper strings and the composite binder as the paper strings are passed through the pultrusion die. The coated paper strings are then further heated to dry the pultruded paper strap out of the pultrusion die.

In some embodiments, a second coat of the composite binder may be applied to improve the adhesion between the strings and the uniformity of the composite binder along the pultruded strap. Optionally, the pultruded paper strap, upon first drying after passing through the first pultrusion die, may pass through another pultrusion die. The paper strap is injected with a second coat of the composite binder and dried again thereafter. The second coat is expected to improve adhesion of the paper strings either at normal ambient conditions, e.g., where the temperature is at approximately 23 degrees Celsius and relative humidity is at 50 to 55 percent or at higher moisture conditions, e.g., where temperature is at approximately 40 to 45 degrees Celsius and relative humidity is at approximately 85 to 90 percent. Again, the second pultrusion die is heated to simultaneously initiate the drying of the paper strings and the composite binder as the paper strap is passing through. The double coated paper strap is then further heated to complete the drying up to a desired moisture content of about 3 to 5% by weight.

In some embodiments, a paper strap having a plurality of strings bonded with a composite binder according to the various embodiments described herein has improved moisture resistance, in that, although the paper strap fully saturates at higher moisture content with respect to a commercial non-repulpable strap, it shows significantly less strength loss. For example, in some embodiments, the paper strap fully saturates at moisture content of 16.89±0.58 percent, whereas the commercial non-repulpable strap fully saturates at a moisture content of 12.16±0.13 percent, both conditioned at 40° C. and 90% RH.

As shown in Table 2, paper straps having a plurality of strings bonded with a composite binder according to the present disclosure required a higher amount of moisture to reach full saturation compared to a commercial non-repulpable paper strap. In particular, a paper strap was formed in a strap pultrusion machine according to the various methods described in the '012 Application. A plurality of Northern bleached softwood kraft (NBSK) twisted paper strings were bonded with a composite binder comprising a partially hydrolyzed PVOH sold under the tradename Poval™ 22-88 at 39.8 percent weight, a fully hydrolyzed PVOH at 21.5 percent weight, and adipic acid at 38.7 percent weight. The paper strings were passed twice through the pultrusion die described in the '012 Application, the paper strings being coated with the composite binder and dried after each pass, having a total coating weight of approximately 7.7 percent by weight. A non-repulpable paper strap having a plurality of NB SK twisted paper strings bonded with a fully hydrolyzed PVOH was also formed according the method described above.

The paper straps comprising the composite binder and the commercial non-repulpable paper straps were both freely conditioned, in that, both strap sides were directly exposed to the conditioning environment, at 40 degrees Celsius and 90 percent relative humidity. As demonstrated in Table 2, various samples of the paper straps comprising an embodiment of the present disclosure, surprisingly and unexpectedly, on average, had a moisture content of 16.9 percent at full saturation. By contrast, samples of a commercial non-repulpable paper strap, on average, had a moisture content of 12.2 percent at full saturation.

TABLE 2

| Sample # | Paper Strap according to one* or more embodiments 23° C./85% RH Saturation Wt. (g) | OD Weight (g) | Moisture Content (%) | 40° C./90% RH Saturation Wt. (g) | OD Weight (g) | Moisture Content (%) | Commercial Non-Repulpable Paper Strap 40° C./90% RH Saturation Wt. (g) | OD Weight (g) | Moisture Content (%) |
|---|---|---|---|---|---|---|---|---|---|
| 1 | 1.0473 | 0.9417 | 11.21 | 1.1078 | 0.9399 | 17.86 | 1.5506 | 1.3801 | 12.35 |
| 2 | 1.0443 | 0.9379 | 11.34 | 1.089 | 0.9307 | 17.01 | 1.551 | 1.3816 | 12.26 |
| 3 | 1.0369 | 0.9323 | 11.22 | 1.084 | 0.9279 | 16.82 | 1.5704 | 1.3979 | 12.34 |
| 4 | 1.0438 | 0.9387 | 11.20 | 1.0904 | 0.9372 | 16.35 | 1.5535 | 1.384 | 12.25 |
| 5 | 1.0295 | 0.927 | 11.06 | 1.0882 | 0.9379 | 16.03 | 1.5675 | 1.3979 | 12.13 |
| 6 | 1.0404 | 0.9369 | 11.05 | 1.0842 | 0.9228 | 17.49 | 1.559 | 1.3917 | 12.02 |
| 7 | 1.0454 | 0.9431 | 10.85 | 1.0948 | 0.9347 | 17.13 | 1.559 | 1.391 | 12.08 |

TABLE 2-continued

| | Paper Strap according to one* or more embodiments | | | | | | Commercial Non-Repulpable Paper Strap | | |
|---|---|---|---|---|---|---|---|---|---|
| | 23° C./85% RH | | | 40° C./90% RH | | | 40° C./90% RH | | |
| Sample # | Saturation Wt. (g) | OD Weight (g) | Moisture Content (%) | Saturation Wt. (g) | OD Weight (g) | Moisture Content (%) | Saturation Wt. (g) | OD Weight (g) | Moisture Content (%) |
| 8 | 1.0334 | 0.9312 | 10.98 | 1.0801 | 0.9271 | 16.50 | 1.5725 | 1.403 | 12.08 |
| 9 | 1.0381 | 0.9352 | 11.00 | 1.0918 | 0.9379 | 16.41 | 1.55 | 1.383 | 12.08 |
| 10 | 1.0384 | 0.9359 | 10.95 | 1.1013 | 0.9386 | 17.33 | 1.5631 | 1.3951 | 12.04 |
| Avg. | | | 11.10 | | | 16.89 | | | 12.16 |
| STD. | | | 0.15 | | | 0.58 | | | 0.13 |

*Composite PVOH based aqueous solution comprising by weight 39.8% of Poval 22-88, 21.5% of Poval 28-99, and 38.7% of adipic acid.

OTHER EXAMPLES

Examples 1 through 9 are directed to paper straps that were formed using a plurality of twisted NBSK paper strings having a diameter of 1.2 mm and a linear density of 0.76 g/m. The NBSK paper strings were bonded with various aqueous binders comprising one or more of a partially hydrolyzed PVOH sold under the tradename Poval™ 22-88, fully hydrolyzed PVOH sold under the tradename Poval™ 28-99, and an adipic acid. As described above, the paper straps were formed using various apparatuses/machines described in the '012 Application and using the various pultrusion methods described therein.

The paper straps were assessed for repulpability using various testing processes and steps specified in TAPPI T 205, which is incorporated herein by reference in its entirety. For example, strips from paper straps according to the various embodiments described herein were conditioned in a disintegrator, e.g., a British disintegrator, at approximately 35 degrees Celsius. The strips, about 1 inch long each, weighed approximately 24 grams. The strips were agitated in the disintegrator at 3000 RPM for 15,000 cycles, an additional 15,000 cycles, and an additional 20,000 cycles, for a total of 50,000 cycles.

Thereafter, handsheets were prepared for the paper straps in an Essex Sheet Mold test machine by using the mixture from the disintegrator. In particular, approximately 70 ml of the test mixture was diluted with water, and agitated five times in six seconds, followed by further agitation two times for six seconds. The wet handsheets were thereafter blotted and pressed using a 25 lb. weight placed on stacked handsheets of 3. Subsequently, the stacked handsheets were dried for approximately 1 hour.

Examples 1 and 2

Example 1 is a paper strap comprising twisted NBSK paper strings that are bonded with a partially hydrolyzed PVOH, sold under the tradename Poval™ 22-88. The water soluble partially hydrolyzed PVOH, sold under the tradename Poval™ 22-88 binder comprised a solid content of approximately 19 percent.

Example 2 is a paper strap comprising twisted NBSK paper strings that are bonded with a fully hydrolyzed PVOH sold under the tradename Poval™ 28-99. The water insoluble fully hydrolyzed PVOH sold under the tradename Poval™ 28-99 binder comprised a solid content of approximately 19 percent.

Figure 2A:
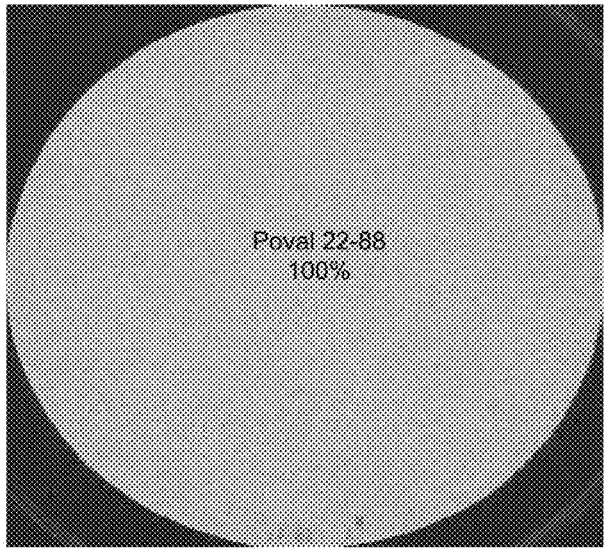
FIG. 2*a* is a photograph of a handsheet of a paper strap bonded with a partially hydrolyzed PVOH binder.

FIG. 2*a* demonstrates a handsheet of the paper strap according to Example 1. As demonstrated in FIG. 2*a*, the paper strap shows a uniform and homogenous sheet that does not include agglomerates of residual non-repulped fibers. Thus, the paper strap of Example 1 is capable of being repulped.

Figure 2B:
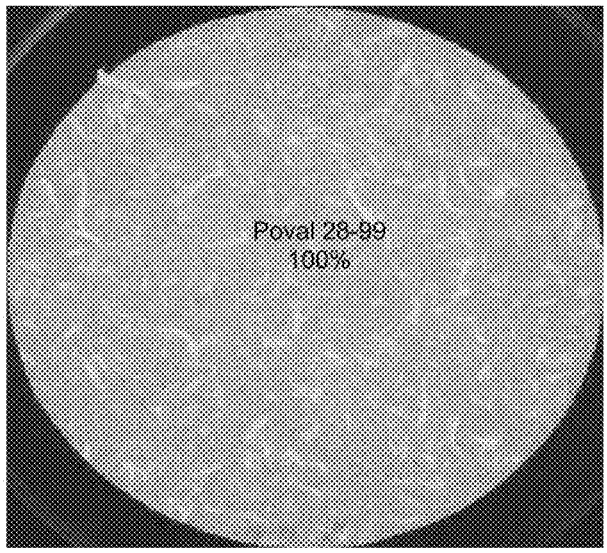
FIG. 2*b* is a photograph of a handsheet of a paper strap bonded with a fully hydrolyzed PVOH binder.

FIG. 2*b* demonstrates a handsheet of the paper strap according to Example 2. As demonstrated in FIG. 2*b*, the paper strap, in contrast to the paper strap of FIG. 2*a*, shows a plurality of fiber agglomerates formed of residual non-repulped fibers still bonded by the water non-soluble fully hydrolyzed PVOH, i.e., Poval™ 28-99. Thus, the paper strap of Example 2 is not repulpable.

Examples 3 and 4

Example 3 is a paper strap comprising twisted NBSK paper strings that are bonded with a hybrid binder comprising a partially hydrolyzed PVOH, Poval™ 22-88, and a fully hydrolyzed PVOH, Poval™ 28-99. On a solid base, the water soluble partially hydrolyzed PVOH, Poval™ 22-88, binder comprised 50% by weight and the water insoluble fully hydrolyzed PVOH, Poval™ 28-99, binder comprised 50% by weight.

Example 4 is a paper strap comprising twisted NBSK paper strings that are bonded with a hybrid binder comprising a partially hydrolyzed PVOH, Poval™ 22-88, and a fully hydrolyzed PVOH, Poval™ 28-99. On a solid base, the water soluble partially hydrolyzed PVOH, Poval™ 22-88, binder comprised 65% by weight and the water insoluble fully hydrolyzed PVOH, Poval™ 28-99, binder comprised 35% by weight.

Figure 3A:
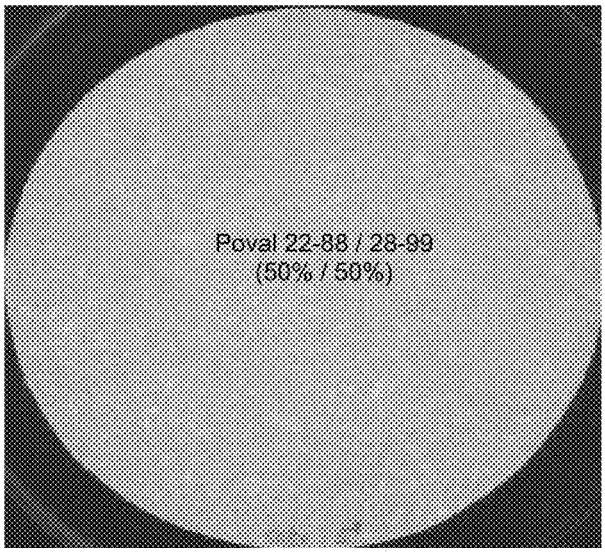
FIG. 3*a* is a photograph of a handsheet of a paper strap bonded with a hybrid binder according to one example, non-limiting embodiment.

FIG. 3*a* demonstrates a handsheet of the paper strap according to Example 3. As demonstrated in FIG. 3*a*, the paper strap shows a reduced number of agglomerates of residual non-repulped fibers.

Figure 3B:
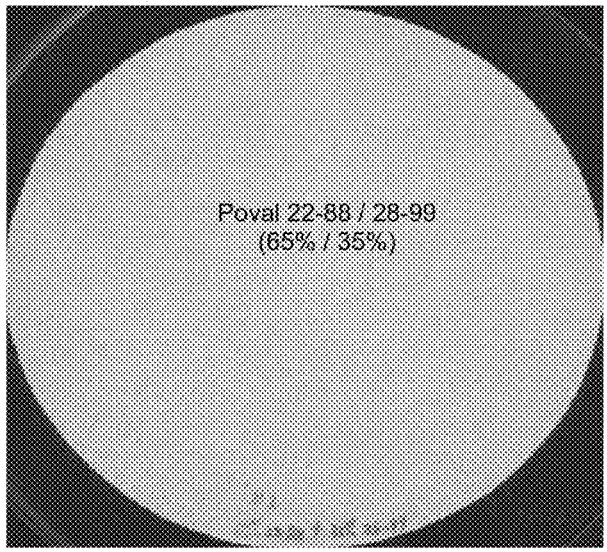
FIG. 3*b* is a photograph of a handsheet of a paper strap bonded with a hybrid binder according to another example, non-limiting embodiment.

FIG. 3*b* demonstrates a handsheet of the paper strap according to Example 4. As demonstrated in FIG. 3*b*, the paper strap, in contrast to the paper strap of FIG. 2*a*, shows a substantially uniform and homogenous sheet that does not include agglomerates formed of residual non-repulped fibers, and, therefore, a paper strap according to example 4 forms a repulpable paper strap.

Examples 5 and 6

Example 5 is a paper strap comprising twisted NBSK paper strings that are bonded with a composite binder comprising a partially hydrolyzed PVOH, Poval™ 22-88, and adipic acid. On a solid base, the water soluble partially hydrolyzed PVOH, Poval™ 22-88, binder comprised approximately 61% by weight and the adipic acid approximately 39 percent by weight, and was pre-dissolved in hot water and then homogenized into the PVOH aqueous solution.

Example 6 is a paper strap comprising twisted NBSK paper strings that are bonded with a composite binder comprising a partially hydrolyzed PVOH, Poval™ 22-88, a fully hydrolyzed PVOH, Poval™ 28-99, and adipic acid. On a solid base, the water soluble partially hydrolyzed PVOH, Poval™ 22-88, binder comprised approximately 40% by weight and the water insoluble fully hydrolyzed PVOH, Poval™ 28-99, binder comprised 22 percent by weight. The adipic acid comprised approximately 39% by weight, and was pre-dissolved in hot water and then homogenized into the PVOH aqueous solution.

Figure 4A:
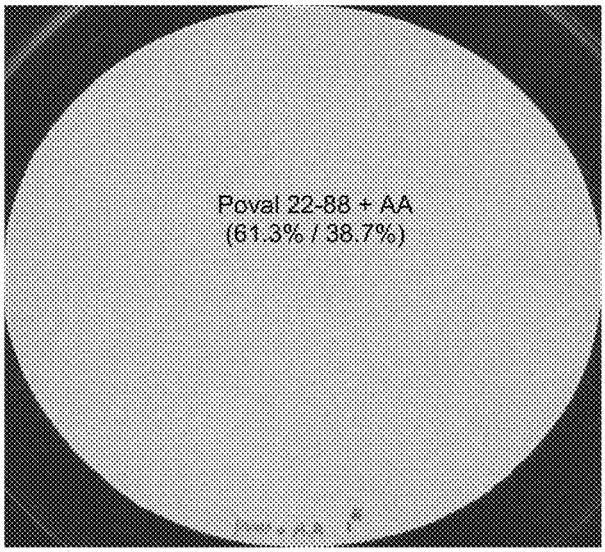
FIG. 4*a* is a photograph of a handsheet of a paper strap bonded with a composite binder according to one example, non-limiting embodiment.

FIG. 4*a* demonstrates a handsheet of the paper strap according to Example 5. As demonstrated in FIG. 4*a*, the paper strap, in contrast to the paper strap of FIG. 2*a*, shows a substantially uniform and homogenous sheet that does not include agglomerates formed of residual non-repulped fibers, and, therefore, a paper strap according to example 5 forms a repulpable paper strap.

Figure 4B:
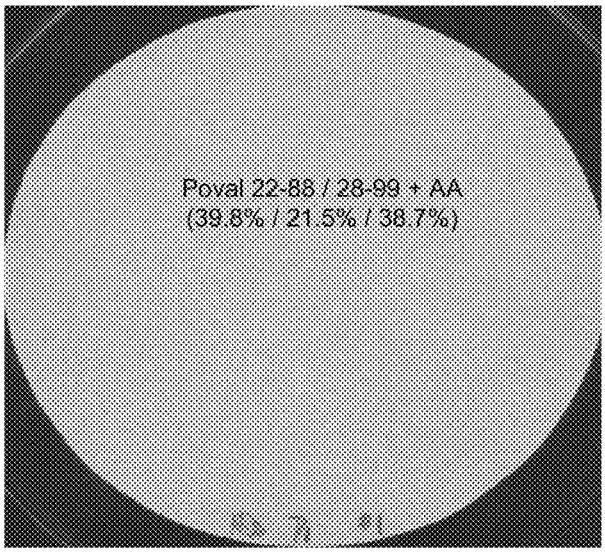
FIG. 4*b* is a photograph of a handsheet of a paper strap bonded with a composite binder according to another example, non-limiting embodiment.

FIG. 4*b* demonstrates a handsheet of the paper strap according to Example 6. As demonstrated in FIG. 4*b*, the paper strap, in contrast to the paper strap of FIG. 2*a*, shows a substantially uniform and homogenous sheet that does not include agglomerates formed of residual non-repulped fibers, and, therefore, a paper strap according to example 6 forms a repulpable paper strap.

In general, therefore, FIGS. 4*a* and 4*b* demonstrate that, despite limited solubility at ambient and light warm water, adipic acid does not hinder repulpability of the paper straps.

Examples 7, 8, and 9

Example 7 is a paper strap comprising twisted NBSK paper strings that are bonded with a composite binder comprising a partially hydrolyzed PVOH, Poval™ 22-88, fully hydrolyzed PVOH, Poval™ 28-99, and adipic acid. On a solid base, the water soluble partially hydrolyzed PVOH, Poval™ 22-88, binder comprised approximately 40% by weight and the water insoluble fully hydrolyzed PVOH, Poval™ 28-99, comprised approximately 22 percent by weight. The adipic acid comprised approximately 39% by weight, and was pre-dissolved in hot water and then homogenized into the PVOH aqueous solution. In this example, a single pass of the composite binder comprising partially hydrolyzed PVOH, Poval™ 22-28, fully hydrolyzed PVOH, Poval™ 28-99, and the adipic acid was injected to wet and coat the twisted paper strings.

Figure 5A:
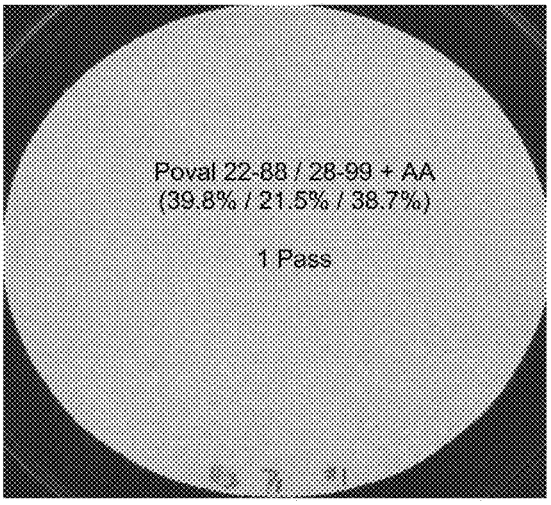
FIG. 5*a* is a photograph of a handsheet of a paper strap bonded with a composite binder according to another example, non-limiting embodiment.

FIG. 5*a* demonstrates a handsheet of the paper strap according to Example 7. As demonstrated in FIG. 5*a*, the paper strap, in contrast to the paper strap of FIG. 2*a*, shows a substantially uniform and homogenous sheet that does not include agglomerates formed of residual non-repulped fibers, and, therefore, a paper strap according to example 7 forms a repulpable paper strap.

Example 8 is a paper strap comprising twisted NBSK paper strings that are bonded with a composite binder comprising a partially hydrolyzed PVOH, Poval™ 22-88, fully hydrolyzed PVOH, Poval™ 28-99, and adipic acid. On a solid base, the water soluble partially hydrolyzed PVOH, Poval™ 22-88, binder comprised approximately 40% by weight and the water insoluble fully hydrolyzed PVOH, Poval™ 28-99, comprised approximately 22 percent by weight. The adipic acid comprised approximately 39% by weight, and was pre-dissolved in hot water and then homogenized into the PVOH aqueous solution. In this example, two passes of the composite binder comprising partially hydrolyzed PVOH, Poval™ 22-28, fully hydrolyzed PVOH, Poval™ 28-99, and the adipic acid were injected to wet and coat the twisted paper strings.

Figure 5B:
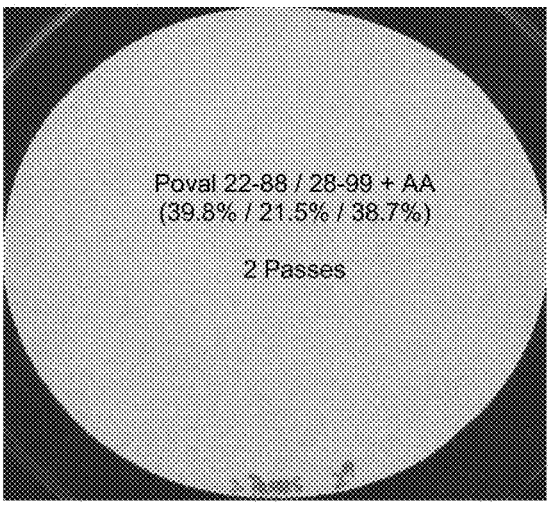
FIG. 5*b* is a photograph of a handsheet of a paper strap bonded with a composite binder according to another example, non-limiting embodiment.

FIG. 5*b* demonstrates a handsheet of the paper strap according to Example 8. As demonstrated in FIG. 5*b*, the paper strap, in contrast to the paper strap of FIG. 2*a*, shows a substantially uniform and homogenous sheet that does not include agglomerates formed of residual non-repulped fibers, and, therefore, a paper strap according to example 8 forms a repulpable paper strap.

Example 9 is a paper strap comprising twisted NBSK paper strings that are bonded with a composite binder comprising a partially hydrolyzed PVOH, Poval™ 22-88, fully hydrolyzed PVOH, Poval™ 28-99, and adipic acid. On a solid base, the water soluble partially hydrolyzed PVOH, Poval™ 22-88, binder comprised approximately 40% by weight and the water insoluble fully hydrolyzed PVOH, Poval™ 28-99, comprised approximately 22 percent by weight. The adipic acid comprised approximately 39% by weight, and was pre-dissolved in hot water and then homogenized into the PVOH aqueous solution. In this example, three passes of the composite binder comprising partially hydrolyzed PVOH, Poval™ 22-28, fully hydrolyzed PVOH, Poval™ 28-99, and the adipic acid were injected to wet and coat the twisted paper strings.

Figure 5C:
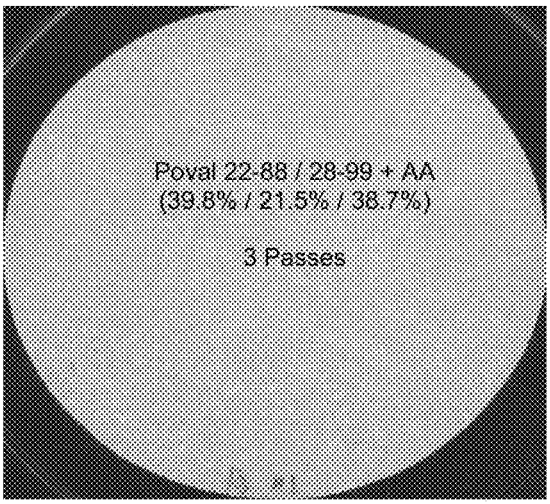
FIG. 5*c* is a photograph of a handsheet of a paper strap bonded with a composite binder according to another example, non-limiting embodiment.

FIG. 5*c* demonstrates a handsheet of the paper strap according to Example 9. As demonstrated in FIG. 5*b*, the paper strap, in contrast to the paper strap of FIG. 2*a*, shows a plurality of fiber agglomerates formed of residual non-repulped fibers. Thus, FIG. 5*c* demonstrates that applying a third coat of the composite binder results in the paper strap becoming non-repulpable.

Figure 6B:
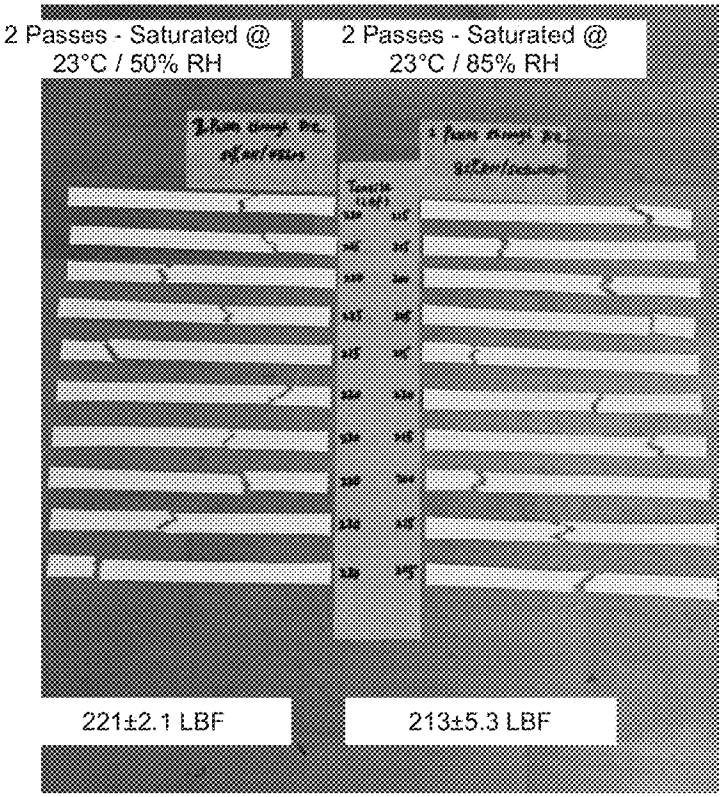
FIG. 6*b* illustrates specimens of paper straps bonded with a composite binder according to an example, non-limiting embodiment after undergoing tensile testing.
Figure 6A:
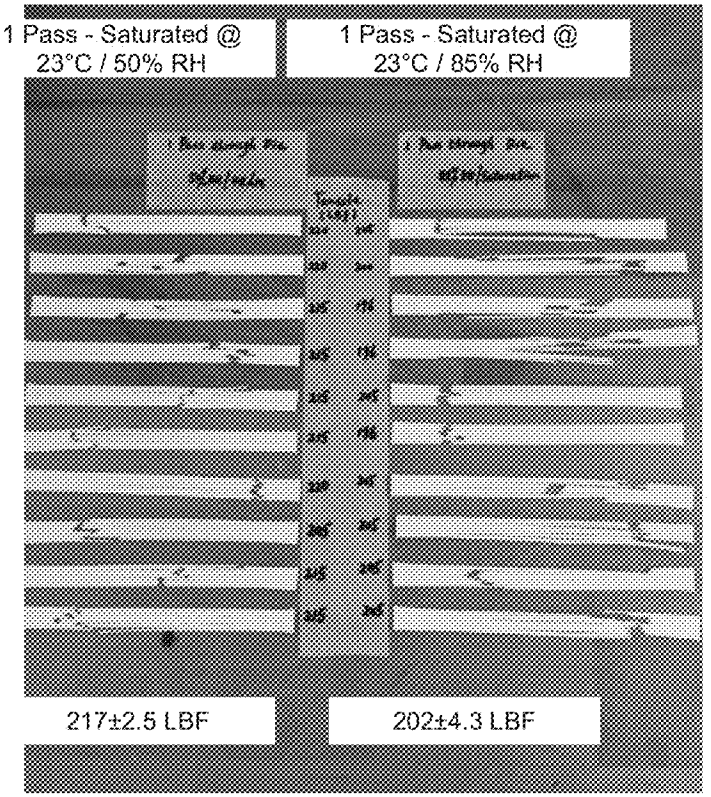
FIG. 6*a* illustrates specimens of paper straps bonded with a composite binder according to an example, non-limiting embodiment after undergoing tensile testing.

FIG. 6*a* demonstrates tensile tests conducted for samples of paper straps according to example 7, wherein a single pass of the composite binder comprising partially hydrolyzed PVOH, Poval™ 22-28, fully hydrolyzed PVOH, Poval™ 28-99, and the adipic acid was injected to wet and coat the twisted paper strings. The samples were thereafter conditioned at 23 degrees Celsius at 85 percent relative humidity and tested for tensile strength. The tensile test results were compared with tensile test results for the baseline of paper straps conditioned at 23 degrees Celsius and 50 percent relative humidity. As shown in FIG. 6*a*, on an average, the baseline paper straps had an average tensile strength of 217 lbf, while the paper straps conditioned at 23 degrees Celsius at 85 percent relative humidity had an average tensile strength of 201 lbf.

FIG. 6*b* demonstrates tensile tests conducted for samples of paper straps according to example 8, wherein a second pass of the composite binder comprising partially hydrolyzed, PVOH Poval™ 22-28, fully hydrolyzed PVOH, Poval™ 28-99, and the adipic acid was injected to wet and coat the twisted paper strings. The samples were thereafter conditioned at 23 degrees Celsius at 85 percent relative humidity and tested for tensile strength. The tensile test results were compared with tensile test results for the baseline of paper straps conditioned at 23 degrees Celsius and 50 percent relative humidity. As shown in FIG. 6*b*, on an average, the baseline paper straps had an average tensile strength of 221 lbf, while the paper straps conditioned at 23 degrees Celsius at 85 percent relative humidity had an average tensile strength of 213 lbf.

FIGS. 6*a* and 6*b*, collectively, demonstrate that the second pass of the composite binder generally fine-tunes the composite binder application, and, therefore, ensures better adhesion between the paper strings either at normal or at high moisture conditions, which may be advantageous in preventing premature strap failure.

Figure 7:
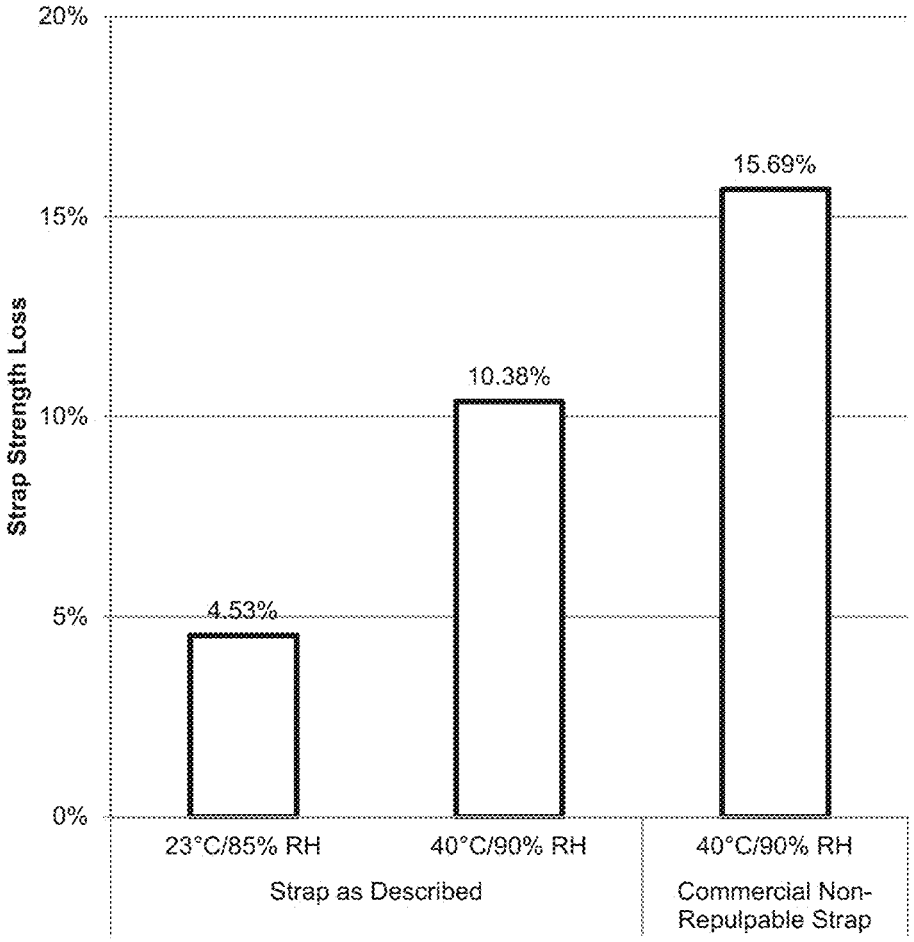
FIG. 7 is a graph demonstrating tensile test results.

FIG. 7 is a graph demonstrating results from tensile tests performed for paper straps according to the various embodiments described herein, and a commercial non-repulpable paper strap. In particular, each sample of the paper straps including the composite binder comprising on a solid base, the water soluble partially hydrolyzed PVOH, Poval™ 22-88, binder at approximately 40% by weight, the water insoluble fully hydrolyzed PVOH, Poval™ 28-99, at approximately 22 percent by weight, and the adipic acid at approximately 39% by weight, was tightly held against a NBSK dry lap from one side thereof. In particular, to simulate conditions of paper straps being wrapped around NBSK dry lap bales, under which one side of the paper strap is exposed to an ambient environment, the testing conditions included tightly holding the paper strap against one side of NB SK dry lap, while the other side of the paper strap was exposed. The samples were then conditioned either at 40 degrees Celsius at 90 percent relative humidity, or 23 degrees Celsius at 85 percent relative humidity until full moisture saturation. Under similar conditions, commercial non-repulpable paper strap samples having a plurality of NB SK twisted paper strings bonded with a PVOH based binder, was tightly held against a NBSK dry lap from one side thereof and conditioned at 40 degrees Celsius at 90 percent relative humidity until full moisture saturation. Samples of both paper straps, namely a paper strap having a composite binder according to example 8 described herein and a commercial non-repulpable paper strap, were tensile tested, and compared with respect to their baselines of paper straps conditioned at 23 degrees Celsius and 50 percent relative humidity. As shown in FIG. 7, the ultimate strength of the commercial non-repulpable paper strap reduced on an average by 15.7 percent, whereas the paper straps according to example 8 described herein conditioned at 40 degrees Celsius at 90 percent relative humidity only reduced by 10.4 percent, while the paper straps according to example 8 conditioned at 23 degrees Celsius at 85 percent relative humidity only reduced by 4.53 percent.

The various embodiments of paper straps described herein enhanced moisture resistance and strength. Moreover, one or more of the various embodiments described above can be combined to provide further embodiments. Further, in some embodiments, the one or more embodiments of the binders described herein (e.g., hybrid binder and/or composite binder), can be used to form paper straps that are folded or unfolded. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A repulpable paper strap comprising:

a plurality of paper strings; and a binder that binds the paper strings together, the binder including a partially hydrolyzed polyvinyl alcohol and a fully hydrolyzed polyvinyl alcohol;

wherein the binder, by dry weight, approximately includes the partially hydrolyzed polyvinyl alcohol between 30 to 70 percent and the fully hydrolyzed polyvinyl alcohol between 20 to 50 percent.

2. The repulpable paper strap of claim 1 wherein the binder further comprises a dicarboxylic acid.

3. The repulpable paper strap of claim 2 wherein the dicarboxylic acid comprises adipic acid.

4. The repulpable paper strap of claim 1 wherein the binder, by dry weight, approximately includes the partially hydrolyzed polyvinyl alcohol at 65 percent and the fully hydrolyzed polyvinyl alcohol at 35 percent.

5. The repulpable paper strap of claim 1, comprising:

a first coat of the binder to bond the paper strings together; and a second coat of the binder to improve adhesion between the paper strings.

6. The repulpable paper strap of claim 1 comprising only two coats of the binder.

7. A method of forming a repulpable paper strap, the method comprising:

providing a plurality of paper strings;

directing the paper strings through one or more pultrusion dies; and injecting a binder to bond the paper strings, the binder including a dicarboxylic acid, a partially hydrolyzed polyvinyl alcohol, and a fully hydrolyzed polyvinyl alcohol;

wherein the binder, by dry weight, approximately includes the partially hydrolyzed polyvinyl alcohol between 30 to 70 percent.

8. The method of claim 7, further comprising:

heating the pultrusion die while the paper strings are passed through the one or more pultrusion dies.

9. The method of claim 8, further comprising:

heating the repulpable paper strap after the repulpable paper strap exits the one or more pultrusion dies.

10. The method of claim 7, wherein injecting the binder includes injecting two coats of the binder.

11. The method of claim 10, comprising:

directing the paper strings through a first one of the one or more pultrusion dies;

injecting a first coat of the binder, the paper strings forming the repulpable paper strap after exiting the first one of the one or more pultrusion dies;

directing the repulpable paper strap through a second one of the one or more pultrusion dies; and injecting a second coat of the binder.

12. The method of claim 7 wherein the binder, by dry weight, approximately includes the partially hydrolyzed polyvinyl alcohol at 65 percent and the fully hydrolyzed polyvinyl alcohol at 35 percent.

13. The method of claim 7 wherein the binder, by dry weight, approximately includes the dicarboxylic acid between 35 to 40 percent.

14. The method of claim 7 wherein the binder, by dry weight, includes the partially hydrolyzed polyvinyl alcohol between 38 to 40 percent, the fully hydrolyzed polyvinyl alcohol between 20 to 22 percent, and the dicarboxylic acid between 38 to 40 percent.

15. A repulpable paper strap comprising:

a plurality of paper strings; and a binder that binds the paper strings together, the binder including a partially hydrolyzed polyvinyl alcohol and a fully hydrolyzed polyvinyl alcohol;

wherein the binder further comprises a dicarboxylic acid and, by dry weight, approximately includes the partially hydrolyzed polyvinyl alcohol between 30 to 70 percent.

16. The repulpable paper strap of claim 15 wherein the binder, by dry weight, approximately includes the fully hydrolyzed polyvinyl alcohol at 19 percent.

17. The repulpable paper strap of claim 15 wherein the binder, by dry weight, approximately includes 35 to 40 percent of the dicarboxylic acid.

18. A repulpable paper strap comprising:

a plurality of paper strings; and a binder that binds the paper strings together, the binder including a partially hydrolyzed polyvinyl alcohol and a fully hydrolyzed polyvinyl alcohol;

wherein the binder, by dry weight, approximately includes a dicarboxylic acid between 35 to 40 percent.

19. A repulpable paper strap comprising:

a plurality of paper strings; and a binder that binds the paper strings together, the binder including a partially hydrolyzed polyvinyl alcohol and a fully hydrolyzed polyvinyl alcohol;

wherein the binder, by dry weight, includes the partially hydrolyzed polyvinyl alcohol between 38 to 40 percent, the fully hydrolyzed polyvinyl alcohol between 20 to 22 percent, and a dicarboxylic acid between 38 to 40 percent.

20. A repulpable paper strap comprising:

a plurality of paper strings; and a binder that binds the paper strings together, the binder including a partially hydrolyzed polyvinyl alcohol and a fully hydrolyzed polyvinyl alcohol;

wherein the strap, when exposed to an environment of between 85 to 90 percent relative humidity and between 35 to 40 degrees Celsius, does not lose more than approximately 2 to 5 percent tensile strength of the repulpable paper strap.

* * * * *